US012420209B2

(12) United States Patent
Zeng et al.

(10) Patent No.: US 12,420,209 B2
(45) Date of Patent: Sep. 23, 2025

(54) INFLATABLE WATER SLIDE

(71) Applicant: BESTWAY INFLATABLES & MATERIAL CORP., Shanghai (CN)

(72) Inventors: Xianglin Zeng, Shanghai (CN); Yunzhe Ban, Shanghai (CN); Qingshui Song, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 79 days.

(21) Appl. No.: 18/511,482

(22) Filed: Nov. 16, 2023

(65) Prior Publication Data

US 2024/0359111 A1 Oct. 31, 2024

(30) Foreign Application Priority Data

Apr. 26, 2023 (CN) ..... 202320982617.2

(51) Int. Cl.
*A63G 21/18* (2006.01)

(52) U.S. Cl.
CPC ..... *A63G 21/18* (2013.01)

(58) Field of Classification Search
None
See application file for complete search history.

(56) References Cited

U.S. PATENT DOCUMENTS 2,982,547 A * 5/1961 Carrier ..... A63G 31/007 472/117
5,548,851 A * 8/1996 Wien ..... A63G 21/18 4/506
5,669,822 A * 9/1997 Smollar ..... A63G 21/18 472/117
6,312,341 B1 * 11/2001 Healy ..... A63G 21/18 472/117
6,406,377 B1 * 6/2002 Demko ..... A63G 21/18 472/117
6,558,264 B2 * 5/2003 Gordon ..... A63G 21/18 472/117
9,186,589 B2 * 11/2015 Anastasia ..... A47C 27/082
9,511,298 B2 * 12/2016 Sgromo ..... A63G 31/12
10,071,318 B1 * 9/2018 Bagumyan ..... A63G 31/12
D849,450 S * 5/2019 Liu ..... D6/604
10,507,394 B2 * 12/2019 Huang ..... A63G 21/18
11,173,407 B2 * 11/2021 Huang ..... A63G 31/12
D980,371 S * 3/2023 Peterson ..... D21/818
11,819,770 B2 * 11/2023 Huang ..... A63G 21/18
12,139,263 B2 * 11/2024 Purushothaman ..... B64D 25/14
D1,064,163 S * 2/2025 Dang ..... D21/814
12,239,234 B2 * 3/2025 Huang ..... A47C 27/081
2007/0000182 A1 * 1/2007 Boujon ..... E04H 4/065 52/2.17
2007/0101488 A1 * 5/2007 Ferraro ..... A63G 21/18 4/496

(Continued)

*Primary Examiner* — Joseph A Dillon, Jr.
(74) *Attorney, Agent, or Firm* — DICKINSON WRIGHT PLLC

(57) ABSTRACT

A water slide is provided including a slide way and an inflatable body fixedly connected to a bottom of the slide way. The inflatable body includes an upper sheet and a lower sheet connected to the upper sheet along a plurality of seams, thus forming a plurality of inflatable tubes. The inflatable tubes are adjacent to one another in a length direction of the slide way and each extends axially in a width direction of the slide way.

17 Claims, 3 Drawing Sheets

(56) References Cited

U.S. PATENT DOCUMENTS

| | | | | |
|---|---|---|---|---|
| 2007/0284188 | A1* | 12/2007 | Chippindale | A62B 1/20 182/48 |
| 2009/0137330 | A1* | 5/2009 | Sefchick | A63G 31/007 472/117 |
| 2018/0280815 | A1* | 10/2018 | Huang | A63G 31/007 |
| 2020/0353371 | A1* | 11/2020 | Huang | A63G 31/12 |
| 2024/0277165 | A1* | 8/2024 | Zeng | A47C 27/081 |

* cited by examiner

INFLATABLE WATER SLIDE

CROSS-REFERENCE TO RELATED APPLICATION

This Application claims priority from Chinese Application CN 202320982617.2, filed Apr. 26, 2023 in China, the disclosure of which is incorporated herein by reference in its entirety.

BACKGROUND

1. Field

Example embodiments relate to inflatable products. More particularly, the present disclosure relates to an inflatable water slide.

2. Description of Related Art

Sliding on water has always been a favorite summer activity for children. An inflatable water slide for sliding on water usually comprises a slide way and a slide that are fixedly placed on the ground, and water is sprayed onto the slide way and the slide by means of a water spray pipe, etc. When in use, a user runs to the inflatable water slide and jumps or throws himself/herself onto the slide or the slide way to be able to slide on the slide way due to inertia.

An existing inflatable water slide merely uses a single plastic sheet as a slide way or a flat inflatable/water-filled structure as a slide way. The user can lie prone on the slide way and slide along the length direction thereof. However, the slide way in a single shape causes monotonous use experience, which makes the user prone to losing the fun of sliding on water.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, a water slide is provided, comprising: a slide way; and an inflatable body fixedly connected to a bottom of the slide way, the inflatable body comprising: an upper sheet and a lower sheet connected to the upper sheet along a plurality of seams, and defining a plurality of inflatable tubes adjacent to one another in a length direction of the slide way; wherein a length of each of the plurality of inflatable tubes extends axially in a width direction of the slide way.

Each of the plurality of inflatable tubes may have a same radial dimension.

At least a first one of the plurality of inflatable tubes may have a first radial dimension and at least a second one of the plurality of inflatable tubes may have a second radial dimension, different from the first radial dimension.

Each of the plurality of inflatable tubes may be in fluid communication with each other of the plurality of inflatable tubes.

The upper sheet may be welded to the lower sheet along each of the plurality of seams.

Each of the plurality of inflatable tubes may be in fluid communication with each other of the plurality of inflatable tubes by means of at least one notch located at an end portion of each of the plurality of seams.

A middle inflatable tube of the plurality of inflatable tubes may have the first radial dimension, and others of the plurality of inflatable tubes may be arranged at a first side and a second side of the middle inflatable tube, such that the others of the plurality of inflatable tubes have radial dimensions sequentially decreasing with distance from the middle inflatable tube.

Radial dimensions of those of the plurality of inflatable tubes disposed at the first side of the middle inflatable tube may have radial dimensions symmetrical to radial dimensions of those of the plurality of inflatable tubes disposed at the second side of the middle inflatable tube.

The inflatable body may further comprise: a main body portion comprising the plurality of inflatable tubes; a first connecting portion, fixed to the bottom of the slide way and extending from the main body portion in the length direction of the slide way, a second connecting portion, fixed to the bottom of the slide way and extending from the main body portion in the length direction of the slide way, opposite the first connecting portion.

The first connecting portion may be welded to the bottom of the slide way and the second connecting portion may be welded to the bottom of the slide way.

Each of the first connecting portion and the second connecting portion may comprise a part of one of the upper sheet and the lower sheet.

The first connecting portion may be welded to one of the upper sheet and the lower sheet; and the second connecting portion may be welded to one of the upper sheet and the lower sheet.

The water slide may further comprise: a plurality of connecting bands, each of the plurality of connecting bands comprising a first end fixedly connected to the upper sheet and the a second end fixedly connected to the bottom of the slide way.

The water slide may further comprise: a plurality of connecting bands, each of the plurality of connecting bands comprising a first end welded to the upper sheet and a second end welded to the bottom of the slide way.

The inflatable body may be fixedly connected to the bottom of the slide way at a position between a first end of the slide way and a second end of the slide way, in the length direction of the slide way.

The inflatable body may further comprise an air valve configured to enable inflation and deflation of the inflatable body.

The water slide may further comprise: a slide connected to a first end of the slide way, and a stop portion connected to a second end of the slide way.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
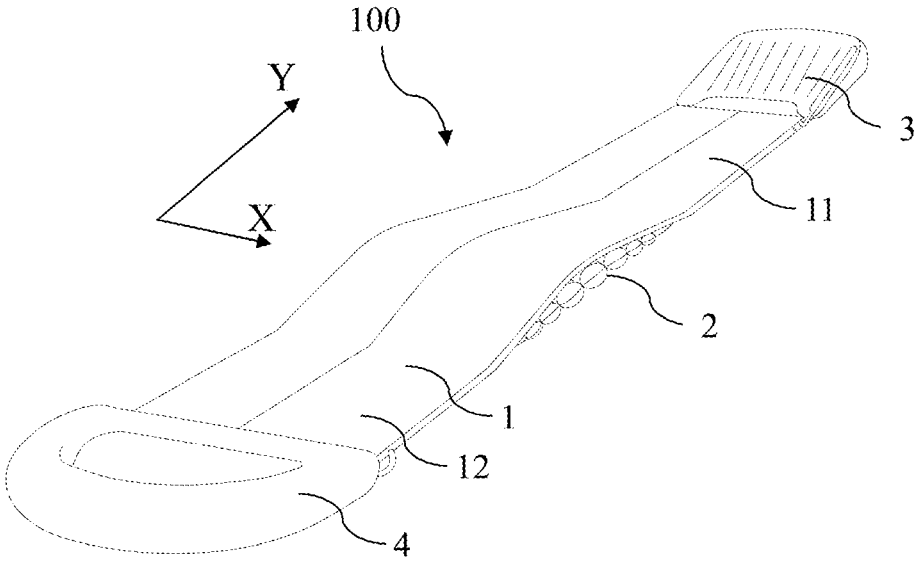
FIG. 1 is a schematic perspective view of a water slide according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

In the description, the expressions of orientations such as "upper," "lower," etc., which are used for describing the structural positions of various components are appropriate when various components are arranged as shown in the figures, but should change accordingly when positions of the various components in the figures change. In the description, unless otherwise explicitly defined or limited, "axial" and "radial" both correspond to an axial direction and a radial direction of an "inflatable tube".

In the description and the accompanying drawings, an X direction represents a width direction of a slide way 1 of a water slide 100, and a Y direction represents a length direction of the slide way 1 of the water slide 100.

Figure 2:
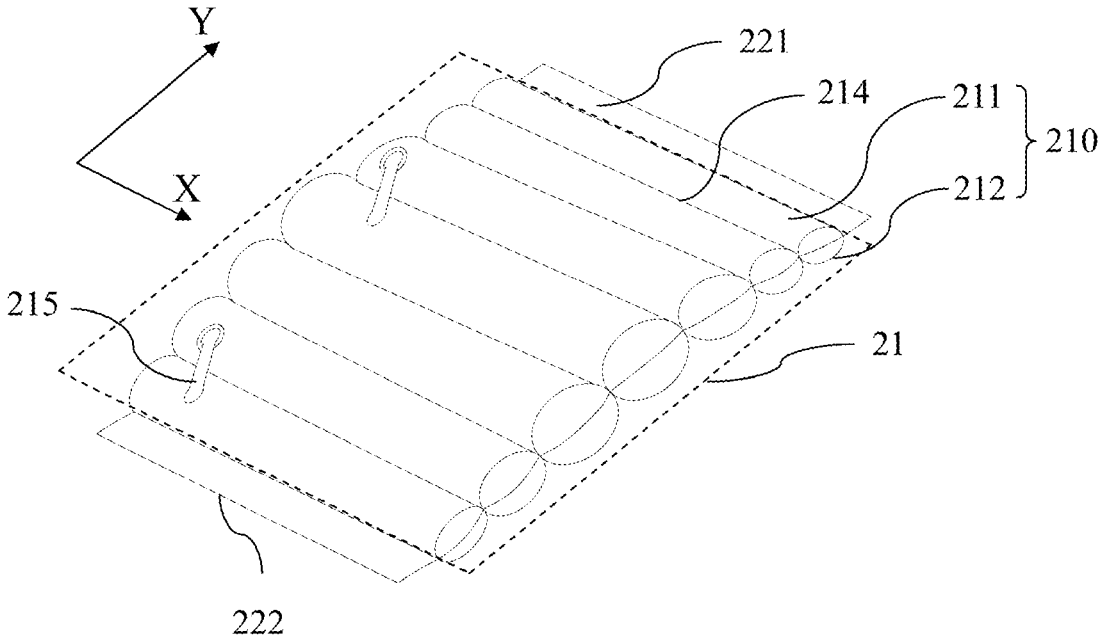
FIG. 2 is a perspective view of an inflatable body of the water slide of FIG. 1.

As shown in FIG. 1 and FIG. 2, the water slide 100 according to this example embodiment comprises the slide way 1 and an inflatable body 2 fixed to the bottom of the slide way 1. The slide way 1 comprises a first end 11 and a second end 12 opposite to the first end 11. The water slide 100 further comprises a slide 3 connected to the first end 11 of the slide way 1 and a stop portion connected to the second end 12 of the slide way 1. When a user jumps or throws himself/herself onto the slide 3 or the slide way 1 from a standing or running state, the slide 3 may provide buffering for the user. The user can slide on the slide way 1 due to inertia. The stop portion 4 located at the second end 12 of the slide way 1 may prevent the user from sliding off the second end 12 of the slide way 1, and the stop portion 4 may have certain elasticity, and may provide certain buffering for the user to protect the user while the user stops sliding.

The inflatable body 2 comprises a main body portion 21 (the part in the dashed box of FIG. 2), and a first connecting portion 221 and a second connecting portion 222 that extend from two sides of the main body portion 21 in the Y direction. Each of the first connecting portion 221 and the second connecting portion 222 extends along the X direction and is fixedly connected to the bottom of the slide way 1.

The main body portion 21 comprises an upper sheet 211 and a lower sheet 212. The upper sheet 211 and the lower sheet 212 are connected to each other to form a plurality of inflatable tubes 210, extending, axially, in the X direction and sequentially arranged in the Y direction. A length of each inflatable tube 210 is approximately the same as a width of the slide way 1. At least two of the inflatable tubes 210 have different radial dimensions, enabling the slide way 1 to be supported by the inflatable body 2 in an undulating shape.

Figure 3:
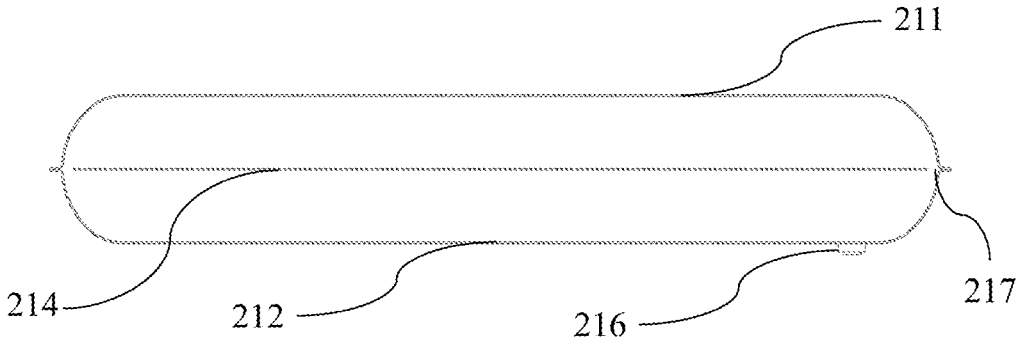
FIG. 3 is a cross-sectional view, in an X-direction, of the water slide of FIG. 1.

As shown in FIG. 2 and FIG. 3, during manufacturing, the upper sheet 211 and the lower sheet 212 are pressed by a molding press to produce a plurality of mold-press seams extending in the X direction, and the mold-press seams are welded to form weld seams 214. By means of the weld seams, the upper sheet 211 and the lower sheet 212 that are connected with each other can be defined as a plurality of tubular inflatable tubes 210 in an inflated state. Two adjacent inflatable tubes 210 of the plurality of inflatable tubes 210 are connected to each other by means of the weld seam 214, and may be in fluid communication with each other by means of at least one notch located at an end portion of the weld seam 214, such that the inflatable tubes 210 form a single air chamber. For example, one notch 217 for air to pass through may be formed in each weld seam 214 close to its X-direction end portion. The bottom of the main body portion 21 (more particularly, the bottom of one inflatable tube 210) is further provided with an air valve 216 for inflating and deflating the single air chamber.

Figure 4:
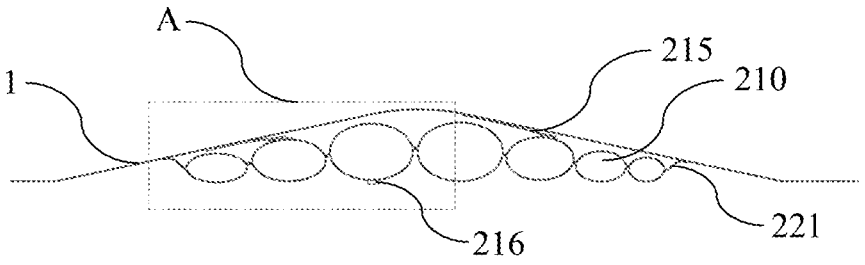
FIG. 4 is a cross-sectional view, in a Y-direction, of the water slide of FIG. 1.
Figure 5:
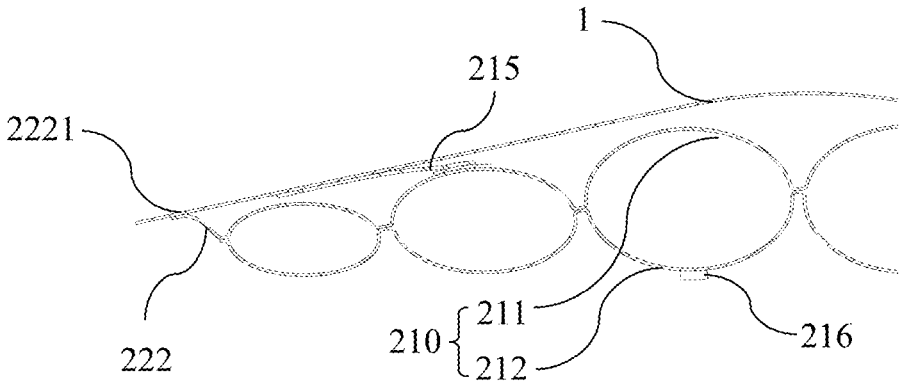
FIG. 5 is an enlarged view of an area A of FIG. 4.

As shown, for example, in FIGS. 2, 4, and 5, each inflatable tube 210 is substantially cylindrical after being inflated, with a cross section that is substantially circular or oval. The diameters of the inflatable tubes 210 may sequentially increase from two sides to the middle in the Y direction such that the slide way 1 supported by the inflatable body 2 is raised toward a middle between the slide 3 and the stop portion 4, forming a gradual a hillside shape. It can be understood that the number and the radial dimensions of the inflatable tubes 210 are variable and may be determined based specific desires, and are not limited to those specifically illustrated. For example, the main body portion 21 may be symmetric with respect to a central axis of the inflatable tube 210 in the middle of the plurality of inflatable tubes 210. For example, according to the illustrated example embodiment, the main body portion 21 comprises seven inflatable tubes 210, the inflatable tube 210 with the largest diameter is arranged in the middle, and three inflatable tubes 210, are provided at each side of the largest inflatable tube 210 in the Y direction, with the diameters of the three side inflatable tubes 210 decreasing with distance from the largest inflatable tube 210. Alternately, a plurality of inflatable tubes 210 may also be provided in an obviously asymmetrical structure. For example, different numbers of inflatable tubes 210, or inflatable tubes with different diameters, may be provided on the two sides of a central inflatable tube 210. According to another alternative, a plurality of inflatable tubes 210, all having a same diameter may be arranged in the main body portion 21.

One or both of the first connecting portion 221 and the second connecting portion 222 may be partially formed by a Y-direction end portion of the upper sheet 211 or of the lower sheet 212, or one or both of the first connecting portion 221 and the second connecting portion 222 may be formed by an independent sheet (for example, a PVC material sheet) and may be fixedly connected to the upper sheet 211 or the lower sheet 212. For example, as shown in FIG. 2, the first connecting portion 221 and the second connecting portion 222 are partially formed by two Y-direction end portions of the upper sheet 211 respectively, and each preferably extends over the entire width of the slide way 1. For example, a Y-direction free end portion of each of the first connecting portion 221 and the second connecting portion 222 (for example, a free end portion 2221 of the second connecting portion 222) is high-frequency welded to the bottom of the slide way 1 to be fixedly connected to the slide way 1.

As shown in FIGS. 2 through 5, the inflatable body 2 further comprises a plurality of connecting bands 215 extending in the Y direction, in the X direction, or extending at an angle between the Y direction and the X direction. Each of the plurality of connecting bands 215 has one end connected to an upper tube wall of an inflatable tube 210, and the other end connected to the bottom of the slide way 1. For example, a first end of one or more of the connecting bands 215 may be high-frequency welded to an upper tube wall of an inflatable tube 210, and a second end of one or more of the connecting bands 215 may be welded or high frequency welded to the bottom of the slide way 1. Alternately, the first and second ends of each of the plurality of connecting bands may be connected to the inflatable tubes 210 and to the slide way in any of a variety of other ways. Thus, together with the first connecting portion 221 and the second connecting portion 222 described above, the plurality of connecting bands 215 help prevent the inflatable body 2 from displacement under the slide way 1. According to the illustrated example embodiment, the top of the main body portion 21 close to its X-direction end portion is provided with two connecting bands 215. It can be understood that the number, the arrangement directions and the positions of the connecting bands 215 are not limited to the described example embodiments, and are variable and may be determined according to determined according specific desire or needs.

The inflatable body 2 may be arranged at any location under the slide way 1. It can be understood that the inflatable body 2 may be fixed to any of a number of different positions under the slide way 1, which makes corresponding positions of the slide way 1 form undulating shapes, thus forming different overall shapes. For example, the inflatable body 2 may be fixedly connected to the bottom of the slide way 1 at a position substantially in a middle position in the Y direction of the slide way 1. Alternately, the inflatable body 2 may be arranged close to a Y-direction end portion of the slide way 1. According to another alternative, a plurality of inflatable bodies 2 may be arranged under the slide way 1, so that the slide way 1 forms a plurality of hillsides.

An inflatable water slide 100 according to one or more example embodiments may enable a user to have a sliding experience of being lifted and lowered in the process of sliding by means of the undulating shape described above, thus increasing the entertainment of use.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. A water slide, comprising:

a slide way comprising a bottom; and an inflatable body fixedly connected to the bottom of the slide way, the inflatable body comprising:

an upper sheet; and a lower sheet connected to the upper sheet along a plurality of seams, and defining a plurality of inflatable tubes adjacent to one another in a length direction of the slide way;

wherein a length of each of the plurality of inflatable tubes extends axially in a width direction of the slide way.

2. The water slide according to claim 1, wherein each of the plurality of inflatable tubes has a same radial dimension.

3. The water slide according to claim 1, wherein at least a first one of the plurality of inflatable tubes has a first radial dimension and at least a second one of the plurality of inflatable tubes has a second radial dimension that is different from the first radial dimension.

4. The water slide according to claim 1, wherein each of the plurality of inflatable tubes is in fluid communication with the others of the plurality of inflatable tubes.

5. The water slide according to claim 1, wherein the upper sheet is welded to the lower sheet along each of the plurality of seams.

6. The water slide according to claim 5, wherein each of the plurality of inflatable tubes is in fluid communication with the others of the plurality of inflatable tubes by means of at least one notch located at an end portion of each of the plurality of seams.

7. The water slide according to claim 3, wherein a middle inflatable tube of the plurality of inflatable tubes has the first radial dimension, and others of the plurality of inflatable tubes are arranged at a first side and a second side of the middle inflatable tube, such that the others of the plurality of inflatable tubes have radial dimensions sequentially decreasing with distance from the middle inflatable tube.

8. The water slide according to claim 7, wherein radial dimensions of those of the plurality of inflatable tubes disposed at the first side of the middle inflatable tube are symmetrical to radial dimensions of those of the plurality of inflatable tubes disposed at the second side of the middle inflatable tube.

9. The water slide according to claim 1, wherein the inflatable body comprises:

a main body portion comprising the plurality of inflatable tubes;

a first connecting portion fixed to the bottom of the slide way and extending from the main body portion in the length direction of the slide way, a second connecting portion fixed to the bottom of the slide way and extending from the main body portion in the length direction of the slide way, opposite the first connecting portion.

10. The water slide according to claim 9, wherein the first connecting portion is welded to the bottom of the slide way and the second connecting portion is welded to the bottom of the slide way.

11. The water slide according to claim 9, wherein each of the first connecting portion and the second connecting portion comprises a part of one of the upper sheet and the lower sheet.

12. The water slide according to claim 9, wherein the first connecting portion is welded to one of the upper sheet and the lower sheet; and wherein the second connecting portion is welded to one of the upper sheet and the lower sheet.

13. The water slide according to claim 1, further comprising:

a plurality of connecting bands, each of the plurality of connecting bands comprising a first end fixedly connected to the upper sheet and the a second end fixedly connected to the bottom of the slide way.

14. The water slide according to claim 1, further comprising:

a plurality of connecting bands, each of the plurality of connecting bands comprising a first end welded to the upper sheet and a second end welded to the bottom of the slide way.

15. The water slide according to claim 1, wherein the inflatable body is fixedly connected to the bottom of the slide way at a position between a first end of the slide way and a second end of the slide way in the length direction of the slide way.

16. The water slide according to claim 1, wherein the inflatable body further comprises an air valve configured to enable inflation and deflation of the inflatable body.

17. The water slide according to claim 1, further comprising:

a slide connected to a first end of the slide way, and a stop portion connected to a second end of the slide way.

* * * * *